US008177651B2

(12) United States Patent
Curry

(10) Patent No.: US 8,177,651 A0
(45) Date of Patent: May 15, 2012

(54) WEIGHTED BALL REBOUNDER

(76) Inventor: Marcus Curry, San Diego, CA (US)

( * ) Notice: Subject to any disclaimer, the term of this patent is extended or adjusted under 35 U.S.C. 154(b) by 0 days.

(21) Appl. No.: 11/297,772

(22) Filed: Dec. 8, 2005

(65) Prior Publication Data

US 2006/0105852 A1 May 18, 2006

Related U.S. Application Data

(63) Continuation of application No. 10/990,761, filed on Nov. 16, 2004, now abandoned.

(51) Int. Cl.
*A63B 69/36* (2006.01)
*A63B 69/00* (2006.01)

(52) U.S. Cl. ..... 473/166; 473/181; 473/435; 473/454; 273/395

(58) Field of Classification Search ..... 473/150, 473/157, 159, 160, 164, 166, 181, 197, 219, 473/435, 454; 482/93, 109; 273/395
See application file for complete search history.

(56) References Cited

U.S. PATENT DOCUMENTS

| | | | | | |
|---|---|---|---|---|---|
| 2,944,816 | A | * | 7/1960 | Dixon | 473/435 |
| 3,427,026 | A | * | 2/1969 | Mahoney | 473/435 |
| 3,502,330 | A | * | 3/1970 | Cheftel | 273/395 |
| 3,752,476 | A | * | 8/1973 | Mahoney | 473/435 |
| 3,836,144 | A | * | 9/1974 | Mahoney | 473/435 |
| 4,063,739 | A | * | 12/1977 | La Rose | 473/197 |
| 4,270,753 | A | | 6/1981 | Maroth et al. | |
| 4,684,133 | A | | 8/1987 | Maroth | |
| 5,776,006 | A | | 7/1998 | Gruber | |
| 5,833,234 | A | * | 11/1998 | Vavala et al. | 473/434 |
| 5,839,968 | A | | 11/1998 | Latella | |
| 5,857,679 | A | * | 1/1999 | Ringe et al. | 273/395 |
| 5,868,634 | A | | 2/1999 | Choi et al. | |
| 5,947,870 | A | * | 9/1999 | Hall et al. | 482/27 |
| 6,010,411 | A | | 1/2000 | Reyes | |
| 6,059,668 | A | | 5/2000 | Marley, Jr. | |
| 6,250,634 | B1 | * | 6/2001 | Strain et al. | 273/395 |
| 6,280,367 | B1 | * | 8/2001 | Arsenault | 482/140 |
| 6,299,554 | B1 | * | 10/2001 | Sinclair et al. | 473/435 |
| D462,733 | S | * | 9/2002 | Smith, IV | D21/780 |
| 6,443,850 | B1 | | 9/2002 | Choi | |
| 6,582,319 | B2 | | 6/2003 | Czaja | |
| 6,607,452 | B2 | | 8/2003 | Helmstetter et al. | |
| 2001/0001094 | A1 | | 5/2001 | Panes | |

OTHER PUBLICATIONS

U.S. Appl. No. 10/990,761, filed Nov. 16, 2004, entitled "Novel Method and Appartus for Increasing the Club Head Speed of a Golfer", Inventor Marcus Curry.

* cited by examiner

*Primary Examiner* — Nini F. Legesse
(74) *Attorney, Agent, or Firm* — Scott J. Fields

(57) ABSTRACT

A weighted ball rebounder and method for increasing power on an athletic performance provide a trampoline member including a resilient sheet affixed to a peripheral frame pivotally coupled to a base and disposed on a substantially horizontal surface. Stabilizing members prevent the rebounder from moving along the surface when a weighted ball such as a 2–20 pound medicine ball, is rebounded therefrom. The trampoline member is angularly adjustable up to 180° in fixed positions. The method provides a user drawing a weighted ball in a direction away from the rebounder, then abruptly swinging the weighted ball toward the rebounder and releasing. The rebounder returns the weighted ball in flight, to the user.

22 Claims, 8 Drawing Sheets

WEIGHTED BALL REBOUNDER

RELATED APPLICATION

This application is a continuation application of presently U.S. application Ser. No. 10/990,761 entitled Novel Method and Apparatus for Increasing the Head Speed of a Golfer, filed Nov. 16, 2004, now abandoned, the contents of which are hereby incorporated by reference as if set forth in their entirety.

FIELD OF THE INVENTION

The present invention relates, most generally, to exercise equipment and in particular to a medicine ball rebounder and also a method for increasing power in an athletic performance by using the medicine ball rebounder.

BACKGROUND OF THE INVENTION

Products and methods for improving an athlete's performance are prolific areas of invention. There are numerous products and devices designed to increase the power and proficiency of athletes in many sporting activities. Athletes that participate in various sports use various workout techniques and equipment to improve their strength and the power they generate when performing or participating in their respective sports such as gymnastics, track and field, baseball, softball, soccer, hockey, football, bowling, tennis, and so forth. In virtually every sport or exercise, it would be advantageous to improve one's strength, power and efficiency. The use of a weighted object such as a medicine ball for exercise and training has been around for quite some time. In recent years, the benefits of using medicine balls for strength and conditioning exercises has become well known and the use of medicine balls for various strength and conditioning exercises popularized. Because of the weight (usually ranging from 2–15 pounds) and inelasticity of the medicine ball, most medicine ball training exercises are necessarily carried out with two or more people. Without the use of a rebounding device, at least two people are required to enable one to perform multiple repetitions of a medicine ball exercise in rapid succession. While some medicine ball rebounders are known in the art, they are of limited versatility and utility. It would be desirable to provide a medicine ball rebounder such as may be used by an athlete to improve power in an athletic performance, that is versatile, stable and durable for use in conjunction with medicine balls having various weights, and which is versatile enough for use in conjunction with various strength and conditioning exercises.

One of the main areas of technological innovation in the field of sports training includes various technologies to increase the length a golfer can drive a golf ball. Various golf ball designs and innovation in golf club materials, designs and innovations are directed to increasing the length of a golf drive. While these products, designs, and product innovations increase the length a golf drive can be made, and therefore the comfort and accuracy of a golf drive made to a particular distance, it would also be desirable to improve the power generated by the golfer him or herself. For a given golf ball and golf club, greater power generated by the golfer results in a longer drive and/or a more controlled shot at a given distance. It would therefore be particularly desirable to improve the power and efficiency generated by a golfer.

SUMMARY OF THE INVENTION

To address these and other needs, and in view of its purposes, the present invention provides a weighted ball rebounder. The weighted ball rebounder includes a trampoline member with a resilient sheet having a periphery affixed to a peripheral frame. The peripheral frame is pivotally coupled to a base that includes a horizontal portion disposed on a horizontal surface such as the ground. A plurality of stabilizing spikes are coupled to the horizontal portion and extend into the ground to prevent translational motion of the base with respect to the ground when a weighted ball rebounds off of the resilient sheet. The trampoline member is angularly adjustable with respect to the horizontal surface. The stabilizing spikes are retractable.

According to another aspect, provided is a weighted ball rebounder that comprises a trampoline member having a periphery affixed to a peripheral frame. The peripheral frame is pivotally coupled to a vertical portion of a base that further includes a horizontal portion disposed on a horizontal surface and is substantially orthogonal to the vertical portion. A retaining member prevents translation of the base along the horizontal surface in response to a weighted ball rebounding off of the trampoline member.

According to another aspect, a method for increasing power generated in an athletic performance is provided. The method includes cupping a weighted ball in palms of a user's hands such that a starting position of the weighted ball is at a center line of the user's pelvis. The method further provides, while cupping the weighted ball, moving the ball away from the user's body and away from a laterally disposed rebounder to a maximum distance, with the target disposed on a surface. While still cupping the ball, the user's arms and the weighted ball are moved abruptly towards the target and the ball released toward the rebounder. The method then provides for the rebounder rebounding the weighted ball in flight toward the user without the rebounder moving along the surface, the weighted ball having a weight of up to 20 pounds.

According to yet another aspect, a method for increasing swing strength and club speed of a golfer is provided. The method includes cupping a weighted ball in the palm of a user's hands such that a starting position of the weighted ball is at a center line of the user's pelvis. While cupping the weighted ball, the method provides for swinging the ball back along the direction of a backswing of a golfer to the top of the backswing. The method further provides, while cupping the weighted ball, moving the user's arms and the weighted ball along a fore swing direction then releasing the ball toward a target during the fore swing. In various embodiments, the target may be a rebounder that rebounds the weighted ball back to the user and the weighted ball may include markings thereon that allow a user to observe the rotation of the weighted ball when in motion and assess the quality of his or her swing based on the rotation.

BRIEF DESCRIPTION OF THE DRAWING

The present invention is best understood from the following detailed description when read in conjunction with the accompanying drawing. It is emphasized that, according to common practice, the various features of the drawing may not always be to scale. Like numerals denote like features throughout the specification and drawing.

DETAILED DESCRIPTION

Figure 1:
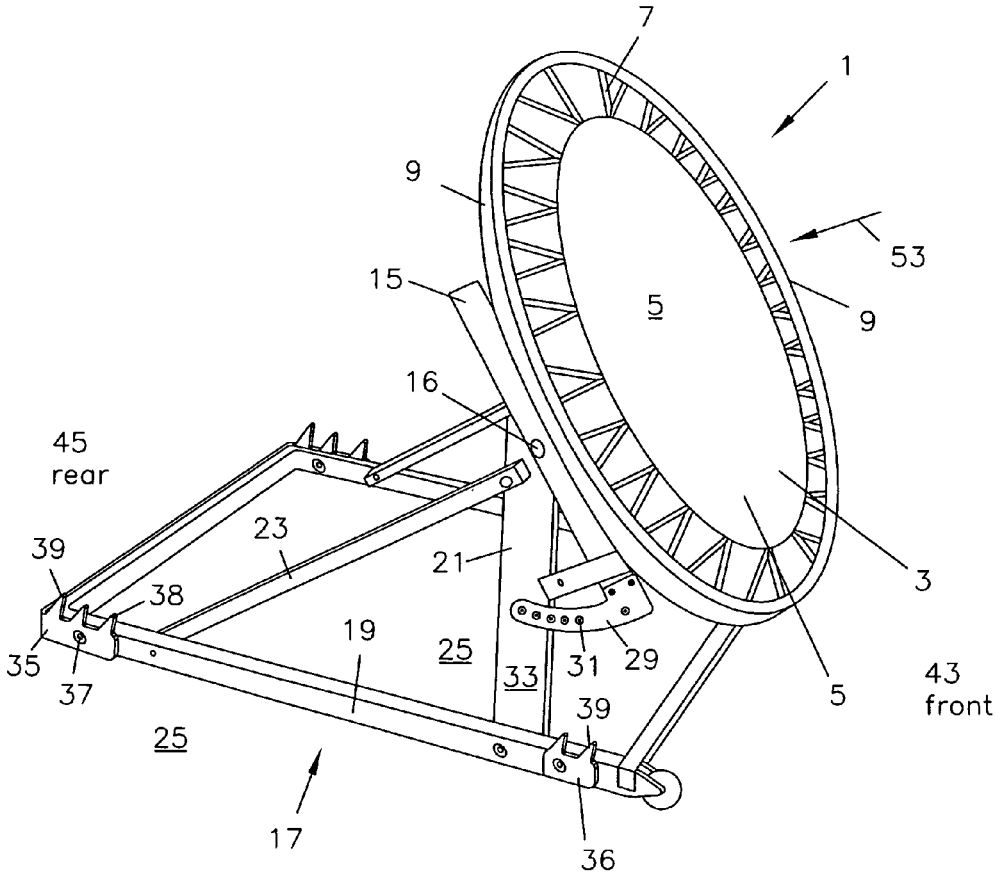
FIG. 1 is a perspective view of an exemplary rebounder of the invention.
Figure 5:
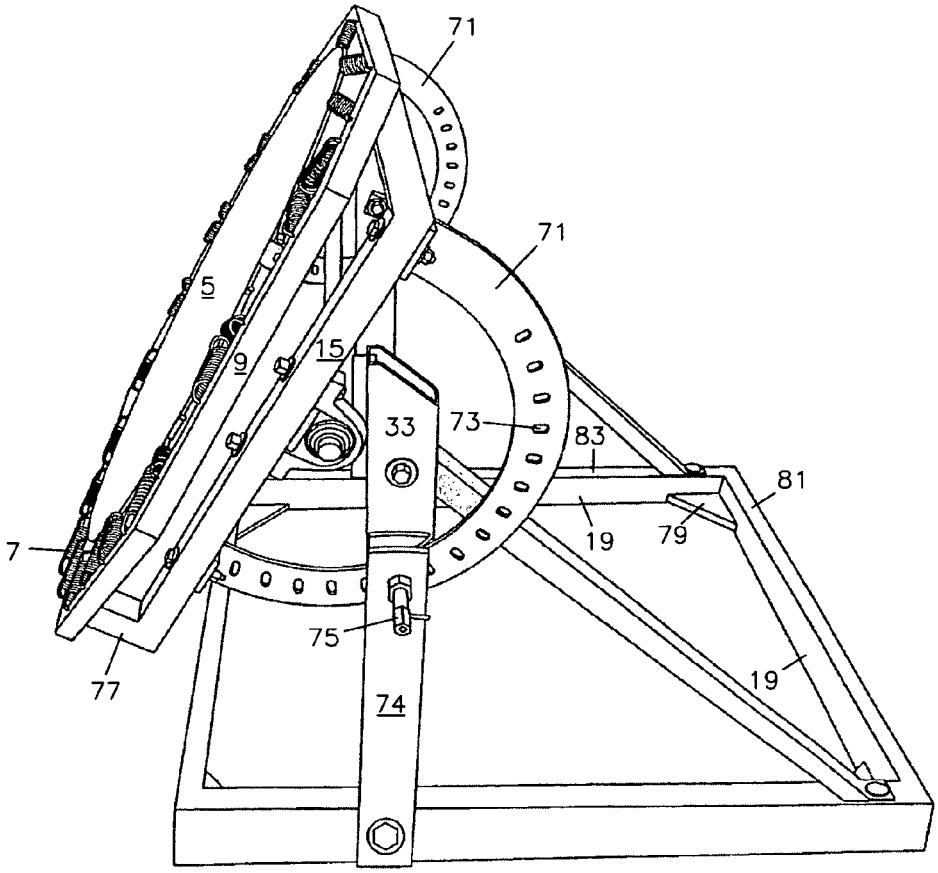
FIG. 5 is a perspective view showing a semi-circular positioning arm according to an aspect of the invention.

FIG. 1 is a perspective view showing an exemplary rebounder of the present invention. Rebounder 1 includes resilient sheet 5 coupled to peripheral frame 9 by springs 7. Together, resilient sheet 5 and peripheral frame 9 form a trampoline member. Resilient sheet 5 includes rebounding surface 3. Resilient sheet 5 may be formed of various materials such as nylon, canvas, or Kevlar. Other suitable materials may be used in other exemplary embodiments. Springs 7 are arranged in pairs of two, each pair arranged in a "V-shape" such that, for each pair, springs 7 are further apart at connection point 11 to peripheral frame 9, than they are at connection point 13 to resilient sheet 5. Base 17 rests on substantially horizontal planar surface 25 which may be the ground, and includes horizontal portion 19 and vertical portion 21 with surface 33. Opposed retaining arms 23 couple horizontal portion 19 to vertical portion 21 and prevent angular movement between horizontal portion 19 and vertical portion 21 when a force is applied along incoming direction 53 such as when a weighted ball is thrown against rebounding surface 3. Peripheral frame 9 is fixedly coupled and parallel to bars 15 which are pivotally coupled to vertical portion 21 of base 17 at pivot point 16. In another exemplary embodiment such as shown in FIG. 5, bars 15 may be spaced from, and parallel to, peripheral frame 9 to accommodate movement of springs 7 and resilient sheet 5 in response to force being applied to resilient sheet 5. Returning to FIG. 1, due to this pivoting, resilient sheet 5 and peripheral frame 7 (i.e., together, the trampoline member) are angularly moveable and adjustable with respect to the ground (surface 25) and in particular, pivotally adjustable with respect to vertical portion 21. Opposed arcuately extending side arms 29 include slits 31 that extend therethrough. Slits 31 may receive a pin or other fastening member that extends through either of slits 31 and into a corresponding opening (obscured by side arms 29 in the illustrated embodiment) formed in vertical portion 21. A hand knob or other device may be used to secure side arm 29 in fixed position with respect to vertical portion 21 and therefore resilient sheet 5 and peripheral frame 9 with respect to surface 25 and base 17. Wheels 41 are attached to horizontal portion 19 of base 17 to enable the rebounder to be rolled when folded for storage as will be seen in FIG. 3. Plates 35 and 36 include stabilizing spikes 39 and are pivotally coupled to horizontal portion 19 of base 17. It will be shown that plates 35 pivot about pivot point 37 so that stabilizing spikes 39 extend into the ground at an oblique angle opposite incoming direction 53, and resist translational movement of rebounder member 1 from front 43 to rear 45 when a force is applied to rebounding surface 3 along incoming direction 53. Stabilizing spikes 39 resist translational motion of base 17 with respect to surface 25, when a medicine ball is rebounded from resilient sheet 5. The rebounding medicine ball may include a weight of up to 20 pounds and the stabilizing spikes prevent motion when a force of 200 lbs. or more is exerted upon resilient sheet 5. Although illustrated plates 35 and 36 include three and two stabilizing spikes, respectively, other numbers of stabilizing spikes may be used in other exemplary embodiments.

Figure 2:
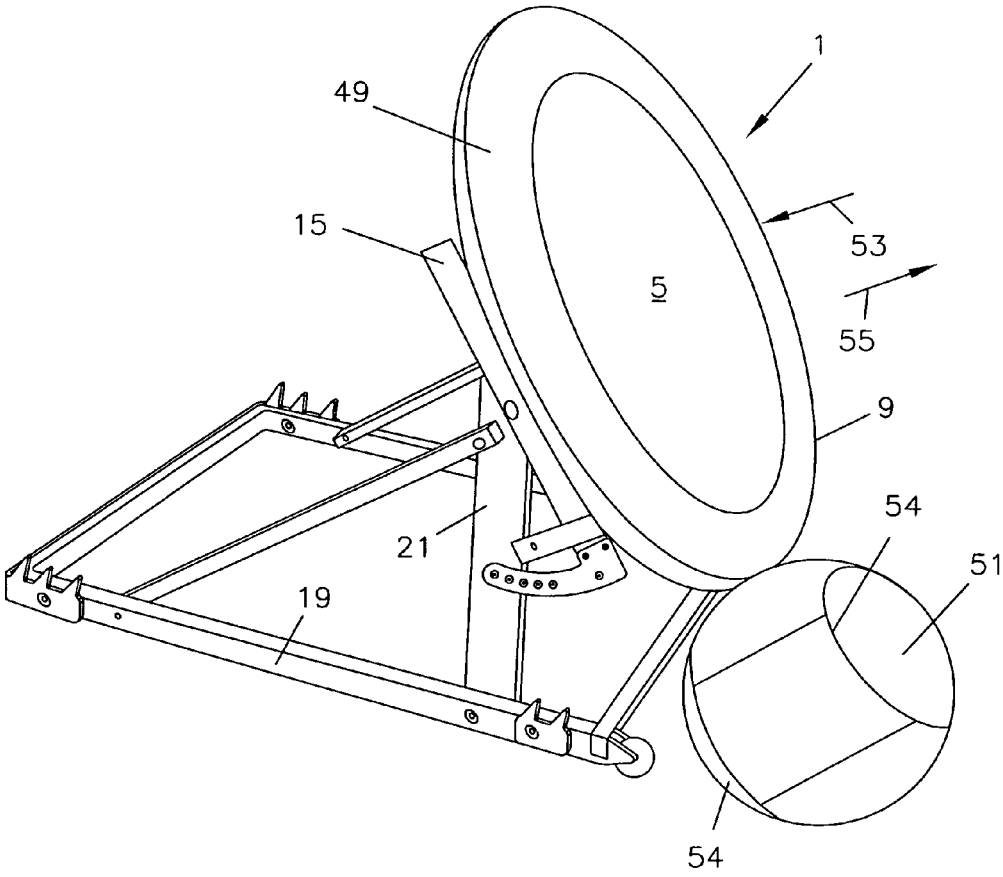
FIG. 2 is a perspective view of an exemplary rebounder of the invention, including an apron thereon.

FIG. 2 shows the rebounding member with apron 49 in place around peripheral frame 9, covering springs 7 and encroaching resilient sheet 5. Apron 49 may be formed of various durable and/or decorative materials and may be sized to provide a target by reducing the visible portion of rebounding surface 3. Incoming direction 53 is the direction along which a weighted ball or other member is projected toward the rebounding member and rebound direction 55 is the return or rebound direction in one exemplary embodiment. Of course, the weighted ball may be projected onto resilient sheet 5 from any of various directions. Exemplary weighted ball 51 may be a medicine ball or other specialized ball and may be of various weights. In exemplary embodiments, weighted ball 51 may be a medicine ball with a weight of 6, 8, 10 or 12–20 pounds, but other weighted balls with other weights may be used in other exemplary embodiments. Weighted ball 51 optionally includes a marking such as stripe 54 which reveals to an observer the rotation of weighted ball 51 when weighted ball 51 is in motion such as in flight.

Figure 3:
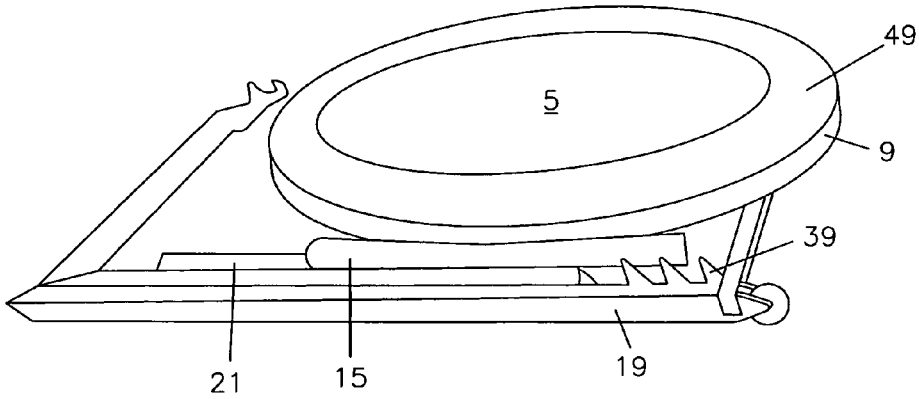
FIG. 3 is a perspective view showing the rebounder of the invention in folded position.

An advantage of rebounder 1 of the invention is that it is foldable for easy and compact storage. FIG. 3 shows rebounder 1 in folded position such that peripheral frame 9 (covered by apron 49), arms 15, vertical portion 21 and horizontal portion 19 are essentially parallel to one another. The components may be locked into fixed position with respect to one another by a securing member such as securing plate 40 shown in FIG. 4.

Figure 4:
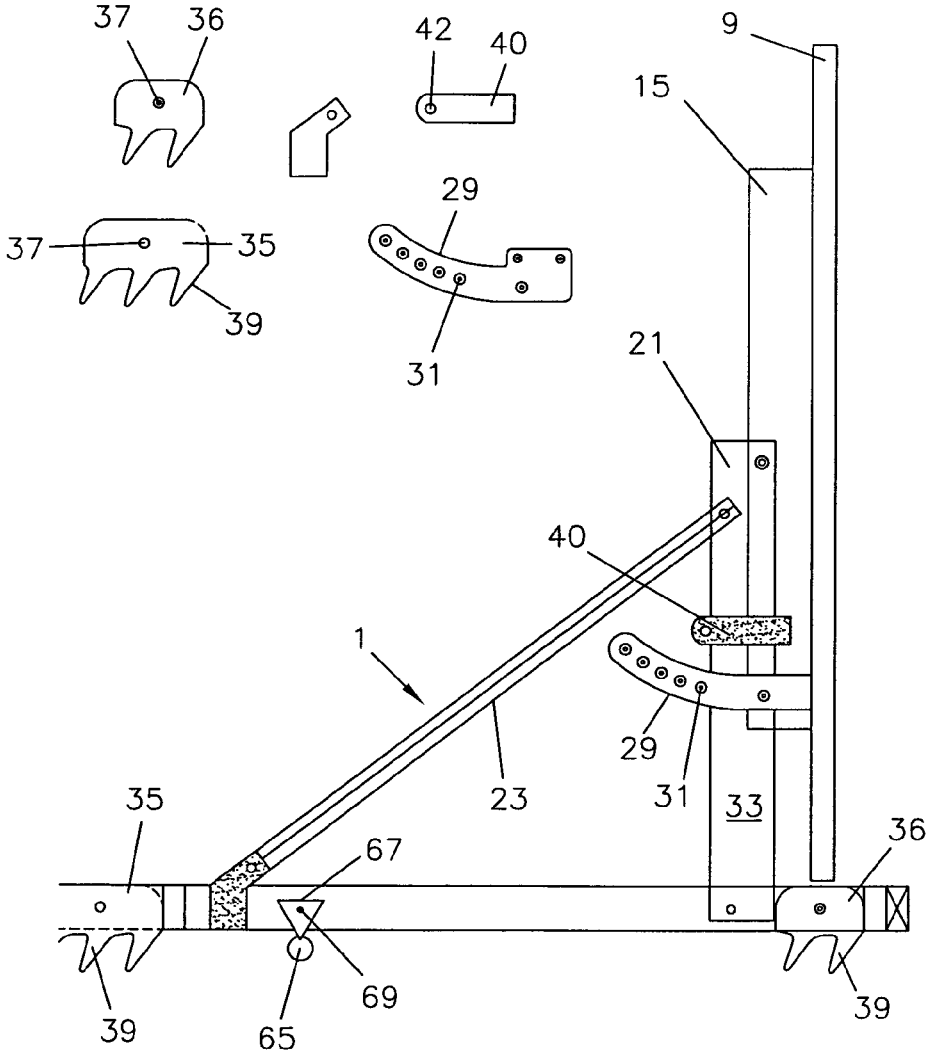
FIG. 4 is a side view of components of the rebounder of the invention.

FIG. 4 is a side view showing an exemplary rebounder. FIG. 4 shows plates 35 and 36, each of which includes stabilizing spikes 39 that are illustrated to extend obliquely into surface 25, e.g., when surface 25 is the ground. Plates 35 and 36 are pivotable, removable and reversible with respect to base 17. FIG. 4 also shows securing plate 40 affixed to arm 15 and for coupling peripheral frame 9 and arm 15 to horizontal portion 19 such as by inserting a pin or other member through opening 42 of securing plate 40, and into an opening formed in horizontal portion 19. Rebound member 5 may therefore be fixedly positioned upward or downward using such a securing pin. FIG. 4 also shows optional wheel 65 affixed to plate 67 which is pivotable and/or removable with respect to horizontal portion 19 by way of connection point 69 which may be a pivot or a removable fastener.

FIG. 5 is a perspective side view of another exemplary embodiment and shows additional features of the rebounder of the invention. In this illustrated embodiment, parallel arm 15 is spaced from and fixedly coupled to peripheral frame 9. Opposed semicircular arms 71 enable rebound surface 3 to rotate 180 degrees with respect to the ground (i.e. surface 25), for example. Each of slits 73 corresponds to a set angular position of peripheral frame 9 with respect to ground 25 and frame 17. FIG. 5 also shows pin 75 extending through plate 74, one of the slits 73 and into an opening formed in surface 33 to secure trampoline 5 and peripheral frame 9 into place. In other exemplary embodiments a rod or spring loaded pin that is coupled to plate 74 may be used. As above, the stabilizing spikes may be reversed as needed to resist movement in opposite lateral directions according to this embodiment. FIG. 5 also shows stabilizing plates 79 which prevent twisting of horizontal portion 19, by preventing angular motion between orthogonal components 81 and 83 of horizontal portion 19, for example. This provides added stability for base 17 of the rebounding device.

The rebounder may be formed of steel, aluminum, titanium other metals or durable sturdy and rigid materials such as wood. The rebounder may be different sizes and may weigh between 25 and 250 pounds in various embodiments. The weight is chosen to be sufficiently heavy to render the rebounder resistant to movement in response to a force applied when a weighted ball having a weight as great as 15 lbs. is propelled against rebound surface 3. In addition to the weight, stabilizing spikes or other retaining members that will be shown in subsequent figures, may be used to prevent the rebounder from lateral translation when a weighted ball is thrown against and rebounded from the trampoline member.

Figure 6:
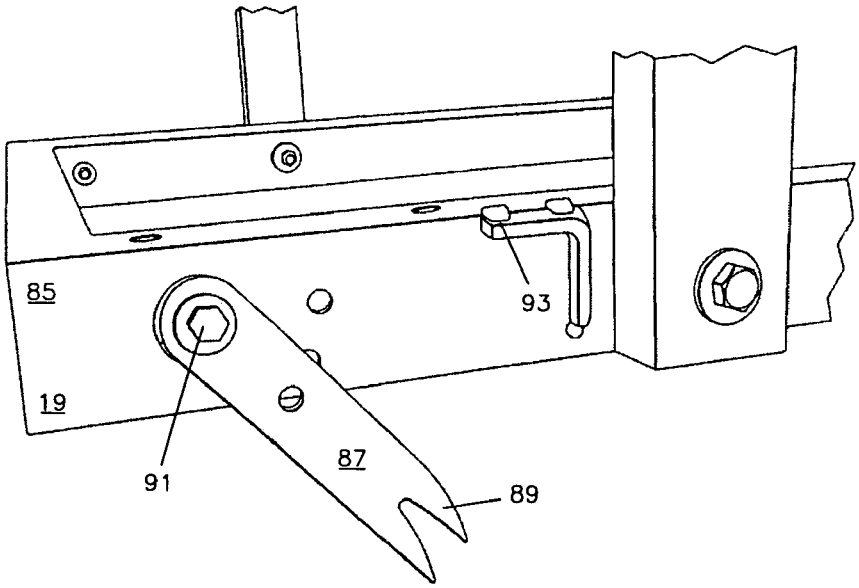
FIGS. 6 and 7 are side views showing exemplary pivoting stabilizing spikes according to the invention.
Figure 7:
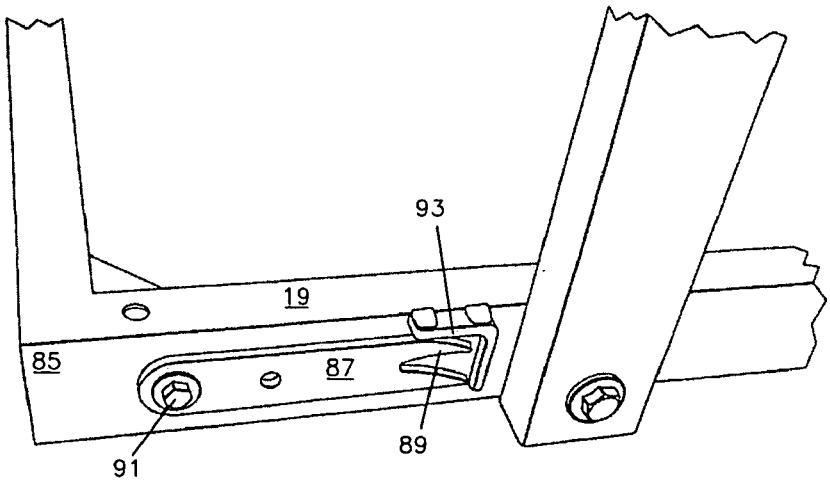

FIGS. 6 and 7 show another exemplary embodiment of stabilizing spikes 89. Plate 87 is pivotally coupled to horizontal portion 19 by pivot point 91 at which a securing member extends through plate 87 and into surface 85 of horizontal portion 19. Stabilizing spikes 89 extend obliquely into the ground when they are being used. When stabilizing spikes 89 are not needed or when the rebounder is being stored, plate 87 pivots about point 91 and is stored along side surface 85 of horizontal portion 19 as shown in FIG. 7 which shows a safety position in which plate 87 and stabilizing spikes 89 do not extend above or below horizontal member 19. Flange 93 attached to side surface 85 prevents plate 87 and stabilizing spikes 89 from extending above the top of horizontal portion 19.

Figure 8:
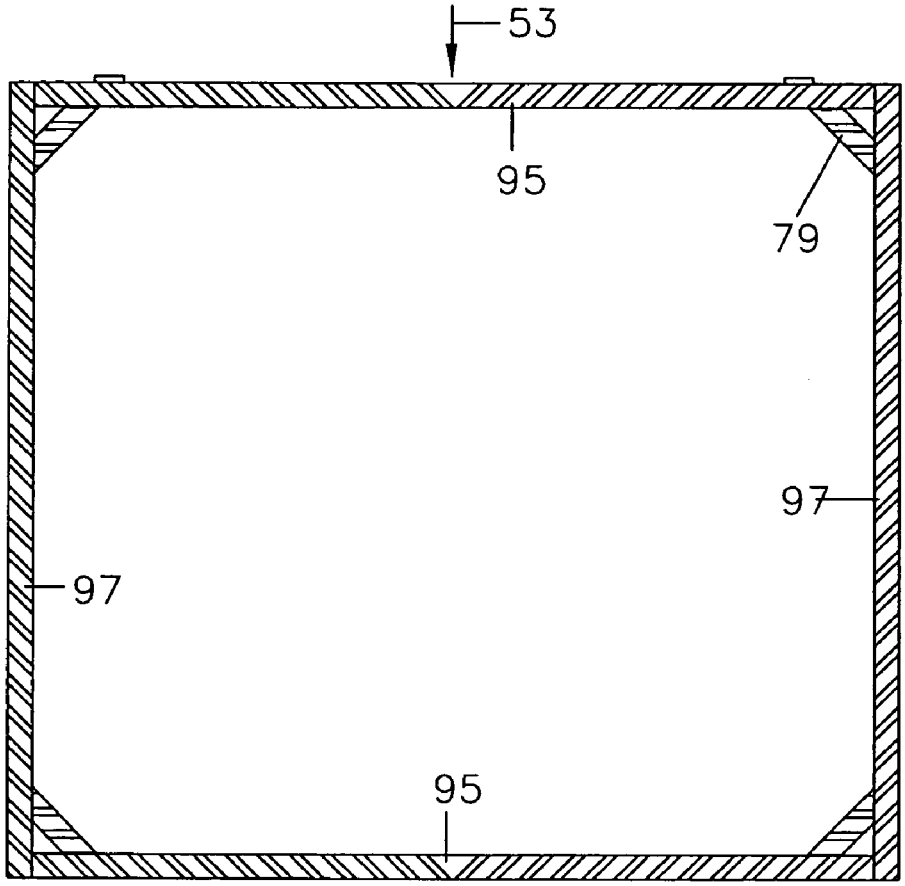
FIG. 8 is a bottom view showing a rubber foot on the underside of the rebounding member, that retains the rebounder in place.
Figure 9:
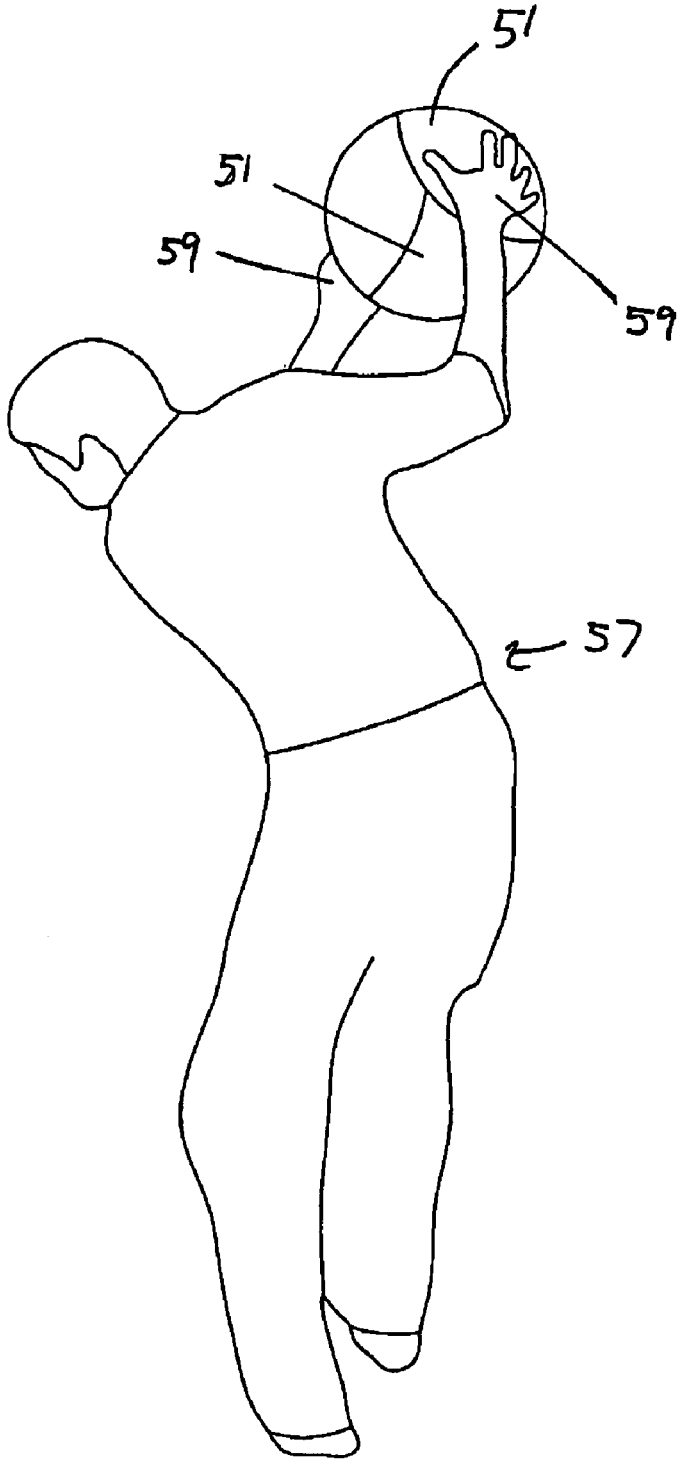
FIG. 9 is a perspective view of the user cupping a weighted ball according to an exemplary method of the invention.

FIG. 8 shows another exemplary embodiment of a retaining member that, together with the weight of the rebounder, prevents lateral translation of base 17 with respect to the ground or another horizontal surface. FIG. 8 shows the underside of base 17 and includes a rubber foot 95 that extends completely around the circumference of base 17 as well as beneath optional stabilizing plates 79. In other exemplary embodiments, rubber foot 95 may only be formed under portions of the bottom of base 17 and/or stabilizing plate 79. Rubber foot 95 includes two groups of a plurality of parallel grooves 97 arcuately disposed with respect to direction 53 of applied force. The design of grooves 97 of rubber foot 95 prevents the translation of the rebounder when a force is applied along force direction 53 and the rebounder is disposed on a smooth surface. In other exemplary embodiments, other retaining members such as suction cups may be used to secure horizontal portion 19 of base 17, to the floor.

The rebounder includes the advantage that it is sufficiently stable and sturdy to rebound a weighted ball without moving and therefore a single user can use the rebounder for various strength and conditioning exercises.

The rebounder may be used for various strength and conditioning exercises. In a more general sense, the rebounder may be used for increasing power generated in an athletic performance. According to one exemplary method, a weighted ball is cupped in the palm of a user's hand such that the starting position of the weighted ball is at a center line of the user's pelvis, but other starting positions may be used in other exemplary embodiments. The rebounder of the invention, or another target, is disposed on the ground and laterally spaced from the user. With the weighted ball still being cupped, the user moves the ball away from his/her body and away from the target e.g. the rebounder, to a maximum distance at a comparatively slow speed. At the peak, top or terminus of the backswing or movement of the weighted ball away from the target, an abrupt forward motion is then carried out and during the forward motion the ball is released toward the rebounder. The weighted ball is rebounded from the rebounder through the air (depending on the angular setting of the trampoline member) without the rebounder moving along the ground. This exercise may be used for various strength and conditioning exercises applicable to many sports and other athletic endeavors.

The preceding merely illustrates the principles of the invention. It will thus be appreciated that those skilled in the art will be able to devise various arrangements which, although not explicitly described or shown herein, embody the principles of the invention and are included within its spirit and scope. Furthermore, all examples and conditional language recited herein are principally intended expressly to be only for pedagogical purposes and to aid the reader in understanding the principles of the invention and the concepts contributed by the inventors to furthering the art, and are to be construed as being without limitation to such specifically recited examples and conditions. Moreover, all statements herein reciting principles, aspects, and embodiments of the invention, as well as specific examples thereof, are intended to encompass both structural and functional equivalents thereof. Additionally, it is intended that such equivalents include both currently known equivalents and equivalents developed in the future, i.e., any elements developed that perform the same function, regardless of structure.

This description of the exemplary embodiments is intended to be read in connection with the figures of the accompanying drawing, which are to be considered part of the entire written description. In the description, relative terms such as "lower," "upper," "horizontal," "vertical," "above," "below," "up," "down," "top" and "bottom" as well as derivatives thereof (e.g., "horizontally," "downwardly," "upwardly," etc.) should be construed to refer to the orientation as then described or as shown in the drawing under discussion. These relative terms are for convenience of description and do not require that the apparatus be constructed or operated in a particular orientation. Terms concerning attachments, coupling and the like, such as "connected" and "interconnected," refer to a relationship wherein structures are secured or attached to one another either directly or indirectly through intervening structures, as well as both movable or rigid attachments or relationships, unless expressly described otherwise.

Although the invention has been described in terms of exemplary embodiments, it is not limited thereto. Rather, the appended claims should be construed broadly, to include other variants and embodiments of the invention, which may be made by those skilled in the art without departing from the scope and range of equivalents of the invention.

What is claimed is:

1. A weighted ball rebounder comprising:

a resilient sheet with a periphery affixed to a peripheral frame, said peripheral frame pivotally coupled to a base that includes a horizontal portion disposed on a substantially horizontal surface and including a plurality of stabilizing spikes coupled thereto, said stabilizing spikes extending into said substantially horizontal surface and preventing motion of said base with respect to said substantially horizontal surface, in response to a weighted ball rebounding off of said resilient sheet, said stabilizing spikes each forming a part of a plate pivotally coupled to a side of said horizontal portion and rotatable with respect thereto, each said plate including at least two of said stabilizing spikes.

2. The weighted ball rebounder as in claim 1, wherein said resilient sheet and peripheral frame form a trampoline member that is angularly adjustable into fixed positions with respect to said substantially horizontal surface.

3. The weighted ball rebounder as in claim 1, wherein said horizontal portion is rectangular and includes stabilizing plates at corners thereof that secure orthogonal components of said horizontal portion and prevent angular motion between said orthogonal components.

4. The weighted ball rebounder as in claim 1, wherein said stabilizing spikes prevent said motion when said weighted ball comprises a pound medicine ball having a weight up to 20 pounds.

5. The weighted ball rebounder as in claim 1, wherein said stabilizing spikes prevent said motion when a force of 200 pounds is exerted against said resilient sheet.

6. The weighted ball rebounder as in claim 1, wherein said peripheral frame is octagonal in shape.

7. The weighted ball rebounder as in claim 1, wherein said substantially horizontal surface comprises ground and said stabilizing spikes extend obliquely into said ground.

8. The weighted ball rebounder as in claim 1, wherein said stabilizing spikes each form part of a plate pivotally coupled to a side of said horizontal portion and rotatable with respect thereto, each said plate including at least two of said stabilizing spikes.

9. The weighted ball rebounder as in claim 1, further comprising wheels at least one of retractably and pivotally attached to said base.

10. The weighted ball rebounder as in claim 1, wherein said resilient sheet is peripherally affixed to said peripheral frame by a plurality of pairs of springs, each pair including said springs arranged in a V-shape, said springs being attached in closer proximity at said resilient sheet and said springs extending outwardly in opposite directions and being attached to said peripheral frame.

11. The weighted ball rebounder as in claim 1, wherein said base further comprises a vertical portion, said peripheral frame pivotally coupled to said vertical portion by means of a plurality of parallel arms fixedly attached to said peripheral frame, said plurality of arms disposed on a side of said resilient sheet opposite a side of said resilient sheet that said weighted ball contacts when rebounding off of said resilient sheet.

12. The weighted ball rebounder as in claim 11, wherein said vertical and horizontal portions are pivotally attached and foldable to be substantially parallel to one another and to said peripheral frame for storage, and further comprising a securing member that secures said vertical portion, said horizontal portion and said peripheral frame in substantially parallel position when folded.

13. The weighted ball rebounder as in claim 11, wherein said arms each include a plurality of slits therein, each slit corresponding to an angular position of said frame with respect to said vertical portion.

14. The weighted ball rebounder as in claim 13, wherein said vertical portion includes at least a receiving opening therein and further comprising a rod simultaneously extendable through any of said slits and said receiving opening, to fix said peripheral frame angularly with respect to said vertical portion.

15. The weighted ball rebounder as in claim 11, wherein said vertical portion includes at least a receiving opening therein and said arms are semi-circular, extend orthogonally from said peripheral frame and include a plurality of position slits that cooperate with said receiving opening to receive a rod therethrough and render a rebounding surface of said resilient sheet rotatable by about 180°.

16. The weighted ball rebounder as in claim 11, further comprising a pair of retaining arms that join said vertical and horizontal portions and prevent angular motion therebetween.

17. The weighted ball rebounder as in claim 16, wherein said stabilizing spikes are positionable to prevent translational motion in each of opposed directions.

18. The weighted ball rebounder as in claim 1, wherein said resilient sheet and said peripheral frame form a trampoline member that is rotatable by about 180° with respect to said substantially horizontal surface and are fixedly positionable in a plurality of angular positions.

19. The weighted ball rebounder as in claim 1, wherein a rebound surface of said trampoline is fixedly positionable such that an upper portion thereof is forward of a lower portion thereof.

20. The weighted ball rebounder as in claim 1, wherein said weighted ball comprises a medicine ball with stripes thereon that indicate a rotation of said medicine ball when in flight.

21. A weighted ball rebounder comprising:

a resilient sheet with a periphery affixed to a peripheral frame, said peripheral frame, said peripheral frame pivotally coupled to a base that includes a horizontal portion disposed on a substantially horizontal surface and including a plurality of stabilizing spikes coupled thereto, said stabilizing spikes extending into substantially horizontal surface and preventing motion of said base with respect to said substantially horizontal surface, in response to a weighted ball rebounding off of said resilient sheet, said stabilizing spikes being in pivotally attached to a side of said horizontal portion and positionable along said side when not in use such that said spikes do not extend above an uppermost surface of said horizontal portion.

22. The weighted ball rebounder as in claim 21, further comprising at least a flange extending laterally from said side such that said stabilizing spikes cannot pivot upwardly past said flange.

* * * * *